US007243793B2

(12) United States Patent
Ho

(10) Patent No.: US 7,243,793 B2
(45) Date of Patent: Jul. 17, 2007

(54) TOOL STORING DEVICE

(76) Inventor: Cheng I Ho, No.13, Yong Yi Road, Tai-Ping City, Taichung Hsien (TW)

( * ) Notice: Subject to any disclaimer, the term of this patent is extended or adjusted under 35 U.S.C. 154(b) by 489 days.

(21) Appl. No.: 10/933,345

(22) Filed: Sep. 3, 2004

(65) Prior Publication Data

US 2005/0167306 A1 Aug. 4, 2005

(30) Foreign Application Priority Data

Feb. 4, 2004 (TW) ..... 93201589 U

(51) Int. Cl.
*B65D 85/28* (2006.01)

(52) U.S. Cl. ..... 206/373; 206/349

(58) Field of Classification Search ..... 206/349, 206/372, 373, 375; 312/902; 224/607
See application file for complete search history.

(56) References Cited

U.S. PATENT DOCUMENTS 2,564,949 A * 8/1951 Bell ..... 223/107
2,646,891 A * 7/1953 Morgan ..... 211/131.2
4,122,944 A * 10/1978 De Napoli ..... 206/349
6,571,998 B2 * 6/2003 Godshaw et al. ..... 224/607
6,892,858 B1 * 5/2005 Zupan ..... 182/129
6,945,442 B2 * 9/2005 Godshaw et al. ..... 224/607
2002/0070137 A1 * 6/2002 Hedges ..... 206/373
2004/0016666 A1 * 1/2004 Redzisz ..... 206/372

* cited by examiner

*Primary Examiner*—David T. Fidei
(74) *Attorney, Agent, or Firm*—Troxell Law Office, PLLC

(57) ABSTRACT

A tool storing device is disclosed. It mainly includes a pair of vertical plates, a solid handle, a first partition, a second partition, and a tool receiving portion. Then, it forms a first storing space and a second storing space. These two vertical plates connected by the solid handle forms a solid structure. Due to the first partition and the second partition, the first and second storing spaces can be slight expended or compressed. By the tool receiving portion design, this invention is a stable and light-weighted storing device, and the variety of its use is increased.

10 Claims, 7 Drawing Sheets

TOOL STORING DEVICE

BACKGROUND OF INVENTION

1. Field of the Invention

The present invention relates to a tool storing device, especially to a tool storing device that can secure both larger objects and smaller objects. For this invention, it provides a stable and light-weighted storing device. And, the variety of its use is increased.

2. Description of the Prior Art

In order to take out or put in a tool conveniently, a user (especially for an outdoor worker) usually needs to put all the required tools (such as hammer, pneumatic tool, etc.) and related objects (different sized screws, nails, drills, etc.) into a soft bag with soft handle to carry. Also, this user can tight an additional rope on the opening of the soft bag for preventing the stored tools dropping down.

However, because the soft bag is deformable, the weight of the stored tools and objects makes this soft bag deformed. All the store tools and objects inside the soft bag will be jammed together. Thus, when the user wants to take out one of them from the soft bag, one tool always collides with or scratches on another. Moreover, if the tool is sharp, it is very possible to hurt the user's hand. Of course, the soft handle tends to be deformed due to the weight of the stored tools and objects, so the user hand is uncomfortable.

For another conventional hand-held tool box, it has a hard structure. It also has a lot of recesses or slots for storing nails, drills, wrenches, and so on (with proper classification). However, in case this conventional tool box is hit by an unexpected force, some of the stored nails, drills or tools might drop down.

In addition, due to its hard structure, when the user does not want to use this conventional tool box, it cannot be detached. So, it still occupies a big space. Therefore, its storage is inconvenient. Besides, when this user carries this kind of conventional tool box and climbs to a higher working place (especially for the builder), it is hard to climb up while one hand is holding the handle of conventional too box.

Thus, it is necessary to design an improved tool storing device to overcome the above-mentioned disadvantages.

SUMMARY OF THE INVENTION

The primary object of the present invention is to provide a tool storing device comprising a pair of vertical plates, a solid handle, a first partition and a second partition. By such design, its storing spaces can be slightly expended and compressed.

The next object of the present invention is to provide a tool storing device. In which, the variety of its use is increased.

Another object of the present invention is to provide a tool device that forms a substantially fixed storing space between these two vertical plates and divided by a solid handle so that it is easy to carry and store. And, it is a stable and light-weighted storing device.

In order to achieve the above-mentioned objects, the present invention provides a technical solution. The tool storing device comprising:

(a) a pair of vertical plates, each of said vertical plates having a fixing portion, a first positioning portion, a second positioning portion, two tilted edges, a front edge and a rear edge;

(b) a solid handle, two ends of said solid handle being secured on said fixing positions of said pair of vertical plates;

(c) a first partition, two ends of said first partition being secured on said first positioning portions of said pair of vertical plates so as to form a first storing space among the vertical plates and said first partition;

(d) a second partition, two ends of said second partition being secured on said second positioning portions of said pair of vertical plates so that said first partition and said second partition forming a second storing space therebetween; an openable covering portion for sealing said second storing space disposed between said front edges of said vertical plates;

(e) a tool receiving portion disposed on said two rear edges of said pair of vertical plates, said tool receiving portion including:

a plurality of inserting slots substantially parallel and disposed between said rear edges of said pair of vertical plates; and one set of foldable side covers coverable on said tool receiving portion.

DETAILED DESCRIPTION OF THE PREFERRED EMBODIMENT

Figure 1:
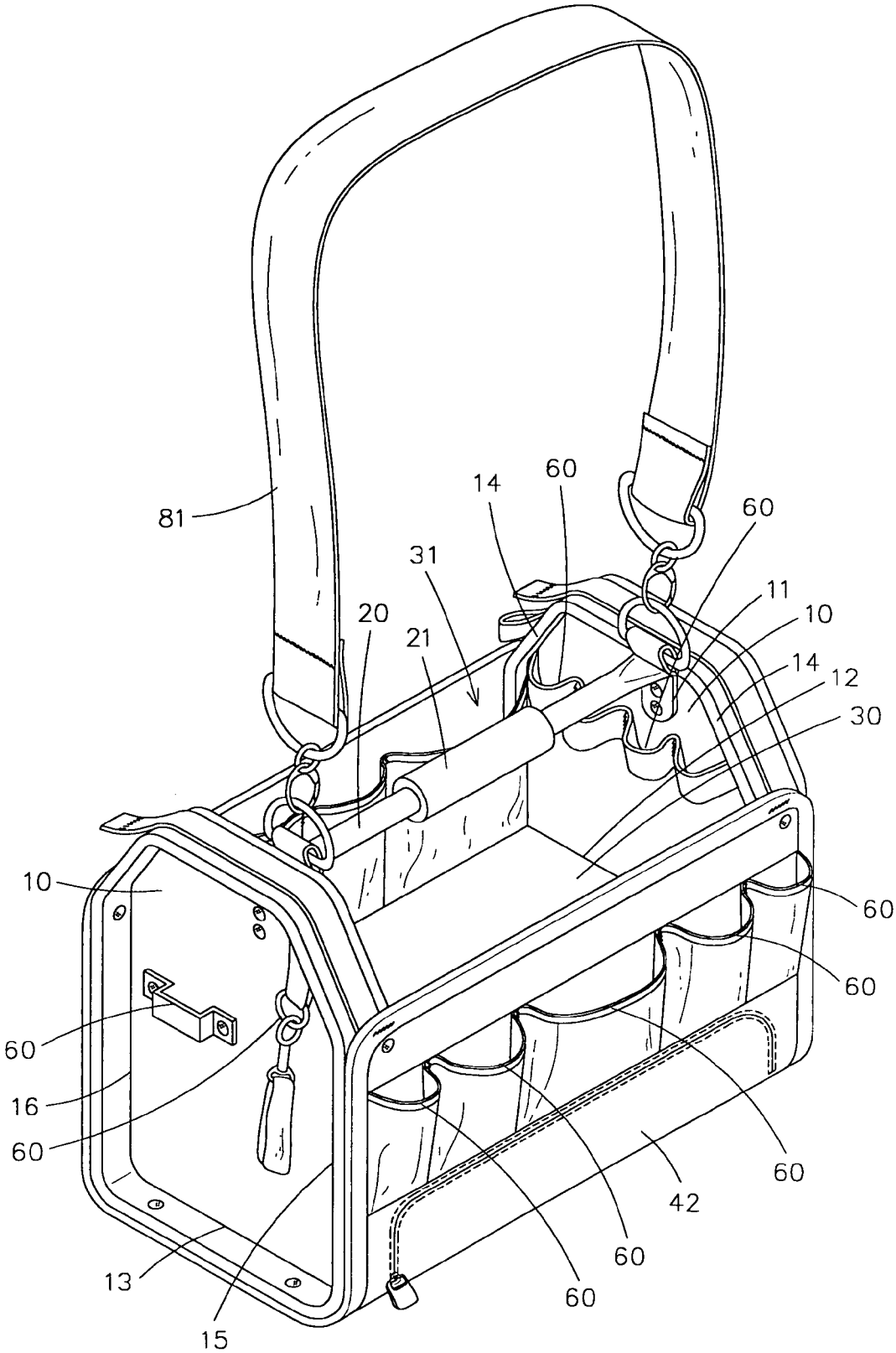
FIG. 1 is a perspective view of this invention.

The present invention invention is a tool storing device. Referring to FIGS. 1 to 5, it comprises:

(a) a pair of vertical plates 10, each of the vertical plates 10 having a fixing portion 11, a first positioning portion 12, a second positioning portion 13, two tilted edges 14, a front edge 15 and a rear edge 16;

(b) a solid handle 20 such as a handle made by stainless steel, two ends of the solid handle 20 being secured on (or integrally connected with) the fixing positions 11 of the pair of vertical plates 10; a middle portion of the solid handle 20 can be wrapped by an elastic element (such as a soft plastic or foamed holding layer) so as to make the holding be more comfortable;

(c) a first partition 30, two ends of the first partition 30 being secured on the first positioning portions 12 of the pair of vertical plates 10 so as to form a first storing space 31 among the vertical plates 10 and the first partition 30; tools (such as hammers, pneumatic tools, etc.) can be stored in the first storing space 31; the first storing space 31 forms two tilted openings that are defined by the tilted edges 14 and the solid handle 20; these two tilted edges face toward the front edges 15 direction and the rear edges 16 direction respectively so that the tools can be taken out conveniently;

(d) a second partition 40, two ends of the second partition 40 being secured on the second positioning portions 13 of the pair of vertical plates 10 so that the first partition 30 and the second partition 40 forming a second storing space 41 therebetween; an openable covering portion 42 for sealing the second storing space 41 disposed between the front edges 15 of the vertical plates 10; and (e) a tool receiving portion 50 disposed on these two rear edges 16 of the pair of vertical plates 10.

The tool receiving portion 50 further includes:

a plurality of inserting slots 51 substantially parallel and disposed between the rear edges 16 of the pair of vertical plates 10 particularly for inserting many tool bits or heads (such as drills of different sizes, etc.) and one set of foldable side covers 52 that are coverable on the tool receiving portion 50.

For example, it contains two foldable side covers 521. Each of the foldable side covers 521 is connected between these two rear edges 16 of the vertical plates 10. These two foldable side covers 521 may be connected and secured by one or more connecting elements 523 (such as a conventional male connecting part and a female connecting part). Thus, this set of foldable side covers 52 can be opened or closed so as to cover the objects stored in the tool receiving portion 50. Of course, there are several auxiliary inserting slots 524 formed in the inner surfaces of the foldable side covers 521. Plus, several additional inserting slots 51 are formed on the outer surfaces of the foldable side covers 521.

For any user, this invention can be operated as follows:

This invention mainly comprises a pair of vertical plates and a single solid handle. They are solid to form a stronger structure. But, the other part of this invention can be soft or deformable. So, the first storing space and the second storing space can be slightly expanded or compressed. When it is the expanded state, the stored hammers or the pneumatic tools can be stored inside easily. When it is the compressed state, the entire volume of this invention is minimized so that it will be easy to store in a smaller space.

The function of the solid handle is to provide a stable and firm holding. Two tilted openings are designed for taking out or putting in the tools quickly and conveniently.

Of course, as shown in FIG. 1, one or more connecting portions 60 (such as a ring made by cloth or by metal) can be disposed on the inner side or on the outer side of the first storing space 31. Therefore, the user can store many kinds of tools (for example, the screw drivers, wrenches with different sizes, small lighting device, etc.).

Figure 2:
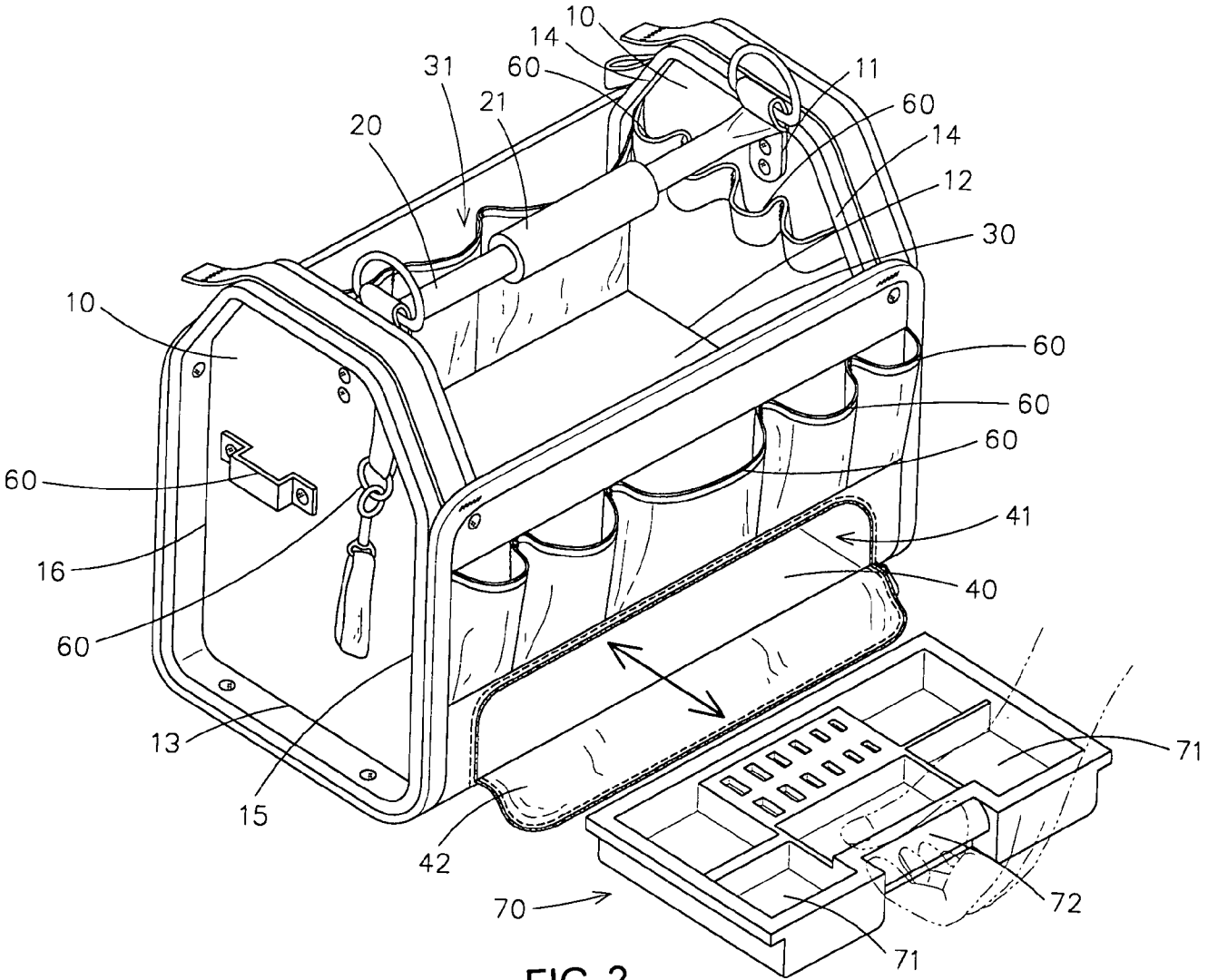
FIG. 2 is a perspective view of this invention when the tool drawer is drawn out.
Figure 3:
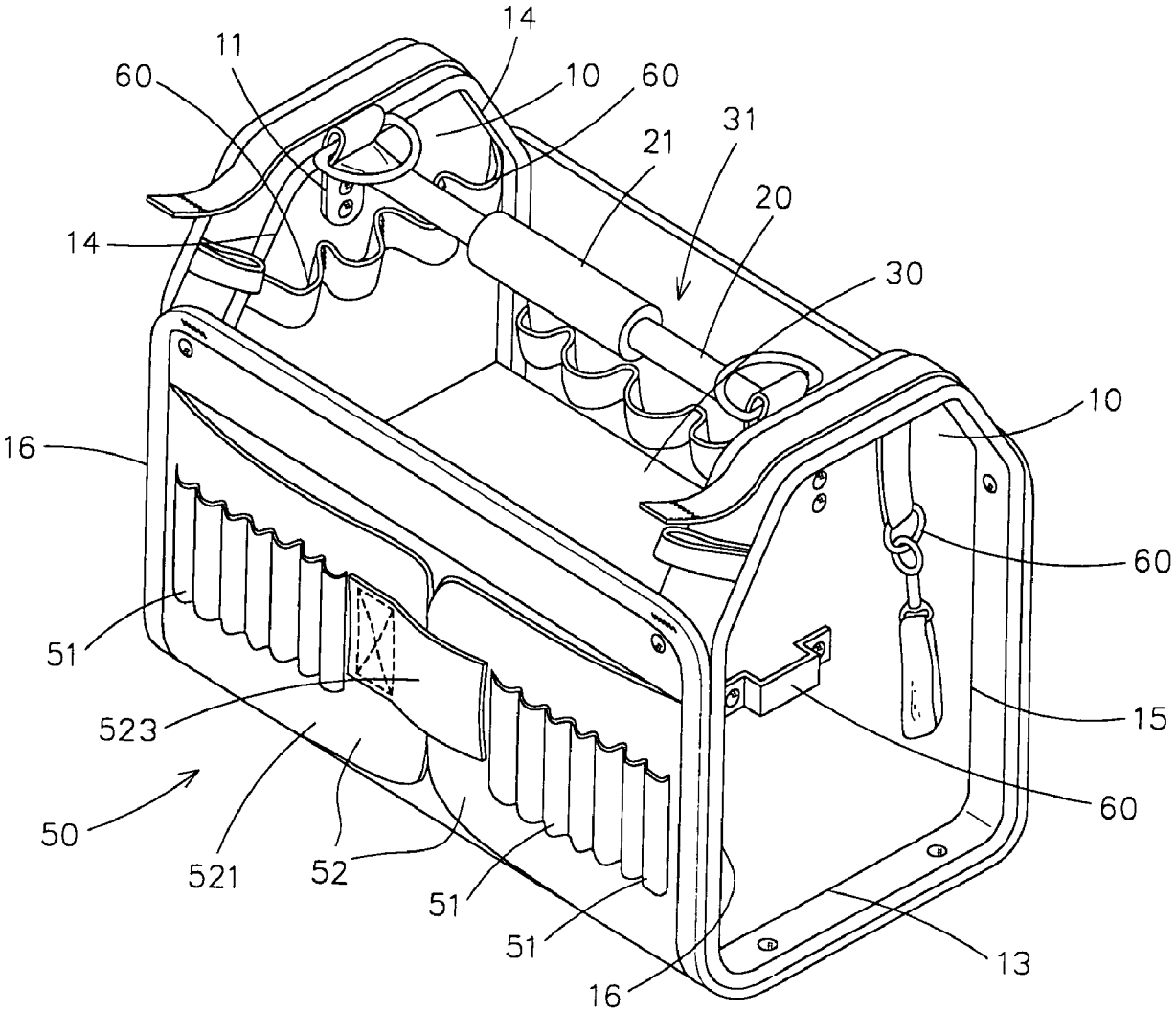
FIG. 3 is another perspective view of this invention.
Figure 4:
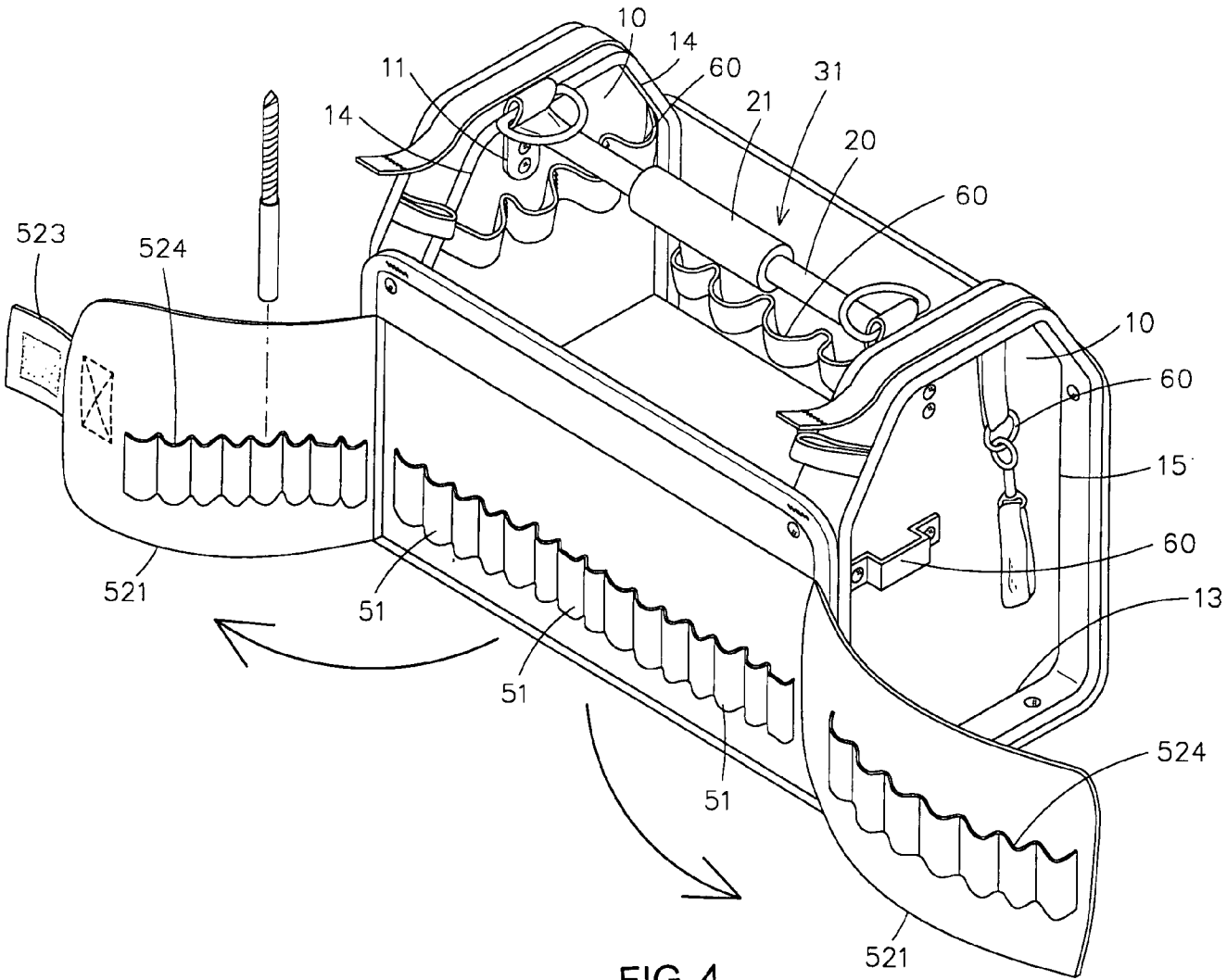
FIG. 4 is another perspective view of this invention with opened foldable side covers.

In addition, as illustrated in FIG. 2, in order to store all these tools tidily, a tool drawer 70 can be added. The tool drawer 70 has a lot of storing recesses 71 for storing smaller tools and/or objects with different sizes and shapes. Especially, the tool drawer 70 is suitable to store screws, nails, rivets or the like. These objects can be easily classified and avoid to harm the user's fingers. And, it can further include a drawer handle 72 for pulling or pushing the tool drawer 70 in (or out) the second storing space 41.

Also, as shown in FIG. 1, this invention can optionally include a shoulder strap 81. Two ends of this shoulder strap 81 are connected to or near the fixing portions 11 of the pair of the vertical plates 10. Hence, by means of the strength of the solid handle 20, this shoulder strap 81 makes this invention to be easily carried to different places.

Figure 5:
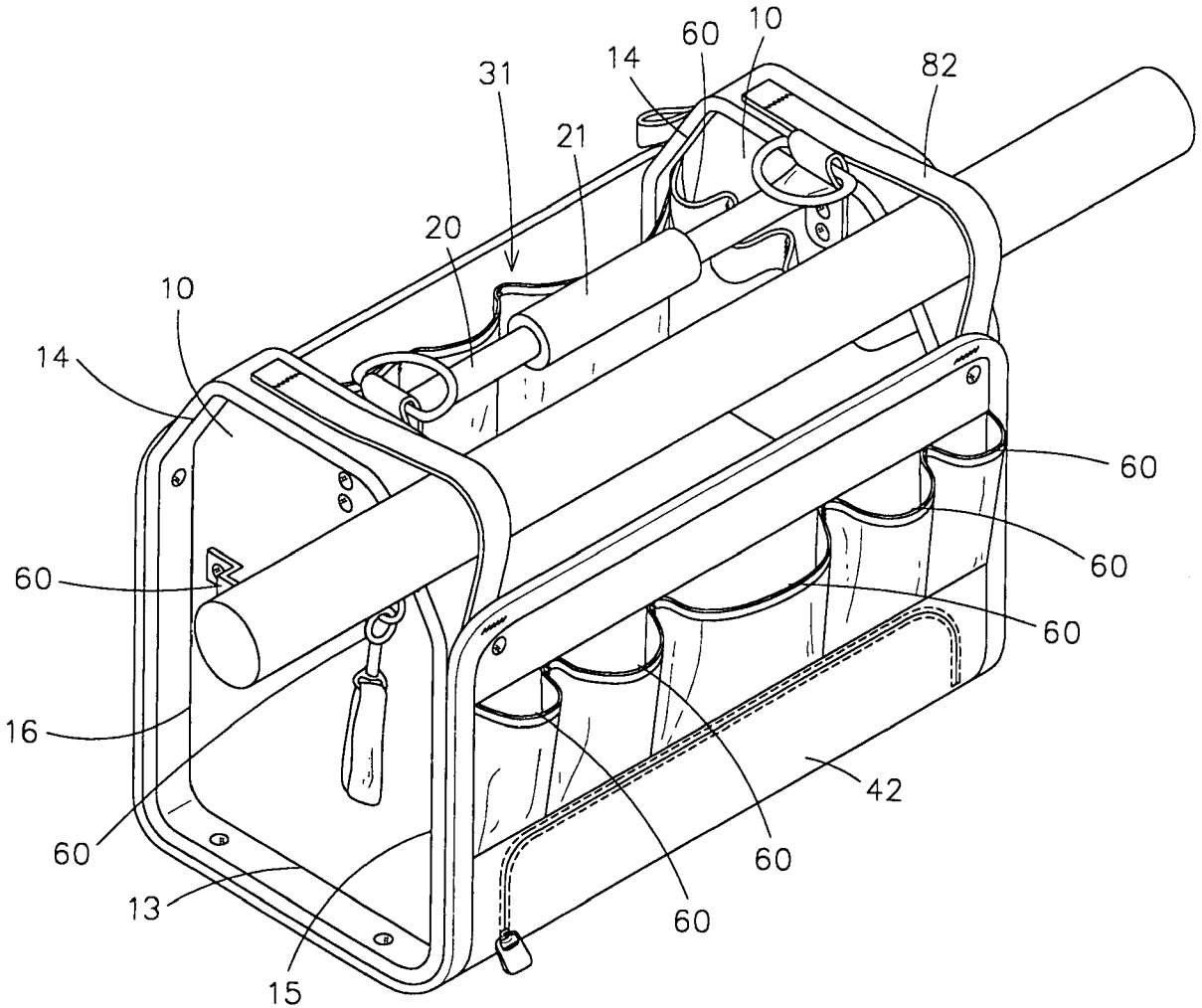
FIG. 5 is a perspective view of other preferred embodiment of this invention.

Furthermore, as illustrated in FIG. 5, one or more holding elements 82 can be mounted on the tiled edge(s) 14 so that a longer object (like long wrench, pipe, ruler, etc.) can be secured on this invention. It will enhance application scope of this invention.

Figure 6:
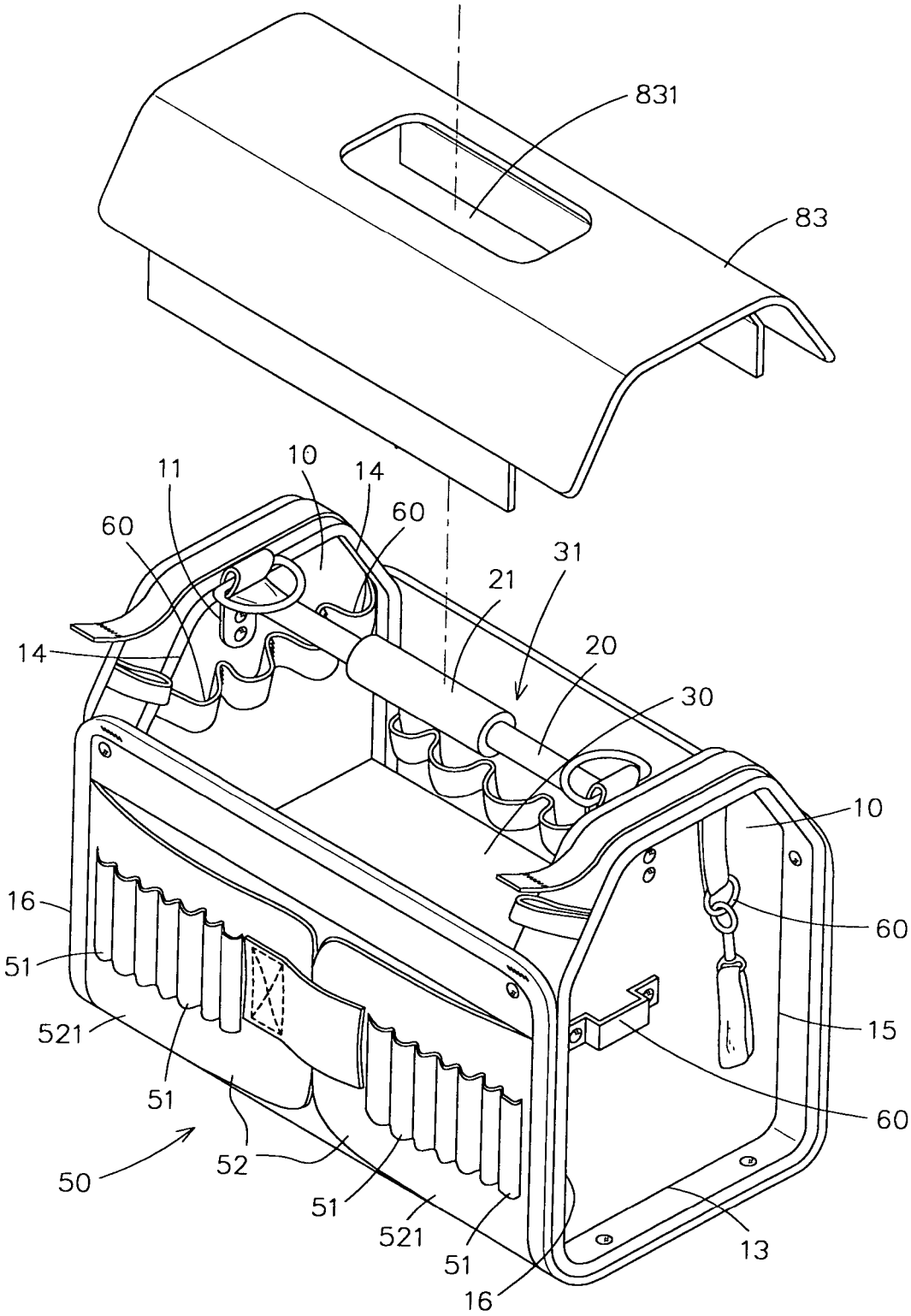
FIG. 6 is a perspective view of another preferred embodiment of this invention.

As shown in FIG. 6, an upper cover 83 is disposed on the first storing space 31. The upper cover 83 covers along the tilted edges 14 of the vertical plates 10 so as to completely cover the tilted openings that communicate with the first storing space 31. Therefore, it can enhance all the stored tools or objects will not drop down. In addition, the upper cover 83 has a through hole 831 to allow the user's hand holding on the solid handle 20.

Figure 7:
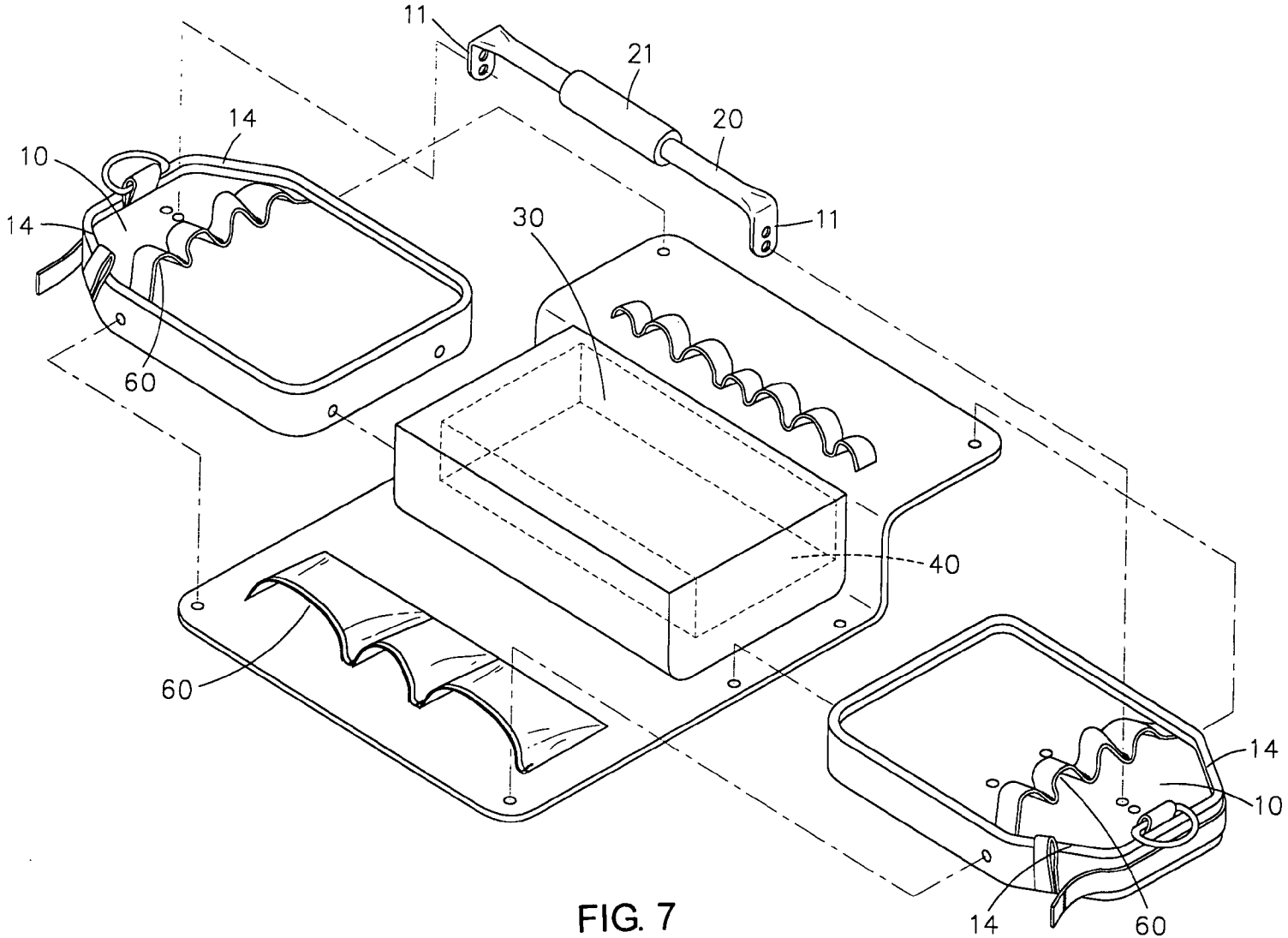
FIG. 7 shows the major parts of this invention have been detached.

Of course, referring to FIG. 7, when this invention is at the condition of "non-use", it can be detached into several separated major parts. That is, the vertical plate 10, solid handle 20, the first partition 30 (connecting with the second partition 40), the tool receiving portion 50 and the securing portion 60 are separated. Thus, they can be packed in a small container or space.

The improvement of this invention can be summarized as follows:

[1] All sharp objects can be safely stored. The present invention has a tool receiving portion. It can store all sharp objects (especially the drills with different sizes) very quickly and tidily. Not only the stored drills can be taken out easily, but also the set of foldable side covers can protect these drills fall down even this invention is up-side-down. So, it significantly enhances its safety. Besides, the foldable side covers are foldable, so both its inner side and outer side can be used to store many drills. Therefore, the total amount for storing the drills is raised.

[2] The variety of its use is increased. The present invention utilized slightly deformable first and second partitions, so the formed storing spaces can be slighted expanded or compressed. For larger tools or objects, they can be stored in the first storing space. For smaller tools or objects, they can be sorted and placed into a tool drawer inside the second storing space and sealed by the covering portion. Thus, the tool drawer will not drop down. Furthermore, by adding a shoulder strap, it becomes easy to carry to any working places. Plus, the major parts of this invention can be separated so it is easy to store or pack this invention in a small space.

[3] It is a stable and light-weighted storing device. This invention is formed by light-weighted vertical plates, a light-weighted solid handle and other parts. It can store many tools or object and can reduce the total weight for the user to carry. Also, by the solid handle, any user can hold this invention quickly.

The above embodiments are only used to illustrate the present invention, not intended to limit the scope thereof. Many modifications of the above embodiments can be made without departing from the spirit of the present invention.

What is claimed is:

1. Tool storing device comprising:

(a) a pair of vertical plates, each of said vertical plates having a fixing portion, a first positioning portion, a second positioning portion, two tilted edges, a front edge and a rear edge;

(b) a solid handle, two ends of said solid handle being secured on said fixing positions of said pair of vertical plates;

(c) a first partition, two ends of said first partition being secured on said first positioning portions of said pair of vertical plates so as to form a first storing space among the vertical plates and said first partition;

(d) a second partition, two ends of said second partition being secured on said second positioning portions of said pair of vertical plates so that said first partition and said second partition forming a second storing space therebetween; an openable covering portion for sealing said second storing space disposed between said front edges of said vertical plates;

(e) a tool receiving portion disposed on said two rear edges of said pair of vertical plates, said tool receiving portion including:

a plurality of inserting slots substantially parallel and disposed between said rear edges of said pair of vertical plates; and one set of foldable side covers coverable on said tool receiving portion.

2. The tool storing device as claimed in claim 1, wherein said solid handle is a solid handle made by stainless steel and a middle portion of said solid handle is wrapped by an elastic element.

3. The tool storing device as claimed in claim 1, wherein the first storing space forms two tilted openings that are defined by the tilted edges and the solid handle; these two tilted openings face toward the front edges direction and the rear edges direction respectively.

4. The tool storing device as claimed in claim 1, wherein each of the foldable side cover is connected between these two rear edges of the vertical plates; these two foldable side covers are connected and secured by one or more connecting elements so as to cover the objects stored in the tool receiving portion.

5. The tool storing device as claimed in claim 4, wherein several auxiliary inserting slots are formed in inner surfaces of said foldable side covers, and several additional inserting slots are formed on outer surfaces of said foldable side covers.

6. The tool storing device as claimed in claim 1, wherein one or more connecting portions are disposed on an inner side or an outer side of said first storing space.

7. The tool storing device as claimed in claim 1, further comprising:

a tool drawer having a plurality of storing recesses and having a drawer handle; said tool drawer being store in said second storing space.

8. The tool storing device as claimed in claim 1, wherein it further comprising:

a should strap, two ends of said shoulder strap being connected to the fixing portions of the pair of the vertical plates so as to allow a user to easily carry at different places.

9. The tool storing device as claimed in claim 1, wherein one or more holding elements are mounted on the tiled surfaces for securing a longer object thereon.

10. Tool storing device as claimed in claim 1, wherein a upper cover is disposed on the first storing space; said upper cover covers along the tilted edges of the vertical plates so as to completely cover the tilted openings which communicate with the first storing space; and the upper cover has a through hole for allowing a user's hand holding on the solid handle.

* * * * *